US009308741B2

(12) United States Patent
Wada et al.

(10) Patent No.: US 9,308,741 B2
(45) Date of Patent: Apr. 12, 2016

(54) PRINTING APPARATUS AND PRINTING METHOD

(71) Applicant: CANON KABUSHIKI KAISHA, Tokyo (JP)

(72) Inventors: Satoshi Wada, Machida (JP); Yoshitomo Marumoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/461,025

(22) Filed: Aug. 15, 2014

(65) Prior Publication Data

US 2015/0054877 A1 Feb. 26, 2015

(30) Foreign Application Priority Data

Aug. 22, 2013 (JP) ..... 2013-172461

(51) Int. Cl.

| | |
|---|---|
| ***B41J 29/38*** | (2006.01) |
| ***B41J 29/393*** | (2006.01) |
| ***B41J 2/21*** | (2006.01) |
| ***B41J 19/14*** | (2006.01) |
| *B41J 11/00* | (2006.01) |

(52) U.S. Cl.
CPC ..... *B41J 2/2135* (2013.01); *B41J 19/142* (2013.01); *B41J 11/0095* (2013.01)

(58) Field of Classification Search
CPC ..... B41J 29/393; B41J 2/2132; B41J 29/38; B41J 11/0095; B41J 2/2135; B41J 11/42; B41J 13/0009; B41J 19/142
USPC ..... 347/9, 12, 14, 15, 16, 19
See application file for complete search history.

(56) References Cited

U.S. PATENT DOCUMENTS

| | | | | |
|---|---|---|---|---|
| 7,726,763 | B2 | 6/2010 | Ochiai et al. | |
| 8,018,621 | B2 | 9/2011 | Marumoto et al. | |
| 8,210,638 | B2 | 7/2012 | Wada et al. | |
| 8,786,896 | B2 | 7/2014 | Marumoto et al. | |
| 2011/0148971 | A1* | 6/2011 | Suzuki et al. | 347/16 |
| 2012/0188562 | A1* | 7/2012 | Marumoto et al. | 358/1.2 |

FOREIGN PATENT DOCUMENTS

| | | | |
|---|---|---|---|
| JP | 2007-190861 | A | 8/2007 |
| JP | 2012-126016 | A | 7/2012 |

* cited by examiner

*Primary Examiner* — Jannelle M Lebron
(74) *Attorney, Agent, or Firm* — Fitzpatrick, Cella, Harper & Scinto

(57) ABSTRACT

A printing apparatus includes: a print head for applying ink on a print medium; a print control unit configured to control the print head; a conveying unit; an obtaining unit configured to obtain information regarding a conveyance error of conveyance of the print medium in a conveying direction crossing a predetermined direction by the conveying unit with respect to each of a plurality of areas of the print medium that are in positions different from each other in the predetermined direction; and an adjusting unit configured to divide a predetermined area of the print medium in accordance with a conveyance error amount indicated by the information in each of the plurality of areas obtained by the obtaining unit into a plurality of correction areas, and to adjust the amount of ink to be applied onto each of the plurality of correction areas lining up in the predetermined direction.

20 Claims, 20 Drawing Sheets

| PRINTING Duty / CONVEYANCE ERROR AMOUNT x | 0~25% | 25~50% | 50~75% | 75~100% |
|---|---|---|---|---|
| -15μm≦x<-5μm | 111 | 112 | 113 | 114 |
| -5μm≦x<+5μm | 121 | | | |
| +5μm≦x≦+15μm | 131 | 132 | 133 | 134 |

FIG.13

| CONVEYANCE ERROR AMOUNT x | MASK |
|---|---|
| $-20\mu m \leqq x < -15\mu m$ | 114 |
| $-15\mu m \leqq x < -10\mu m$ | 113 |
| $-10\mu m \leqq x < -5\mu m$ | 112 |
| $-5\mu m \leqq x < +5\mu m$ | 121 |
| $+5\mu m \leqq x < +10\mu m$ | 132 |
| $+10\mu m \leqq x < +15\mu m$ | 133 |
| $+15\mu m \leqq x \leqq +20\mu m$ | 134 |

FIG.14

PRINTING APPARATUS AND PRINTING METHOD

BACKGROUND OF THE INVENTION

1. Field of the Invention

The present invention relates to a printing apparatus and a printing method, and in particular, to a printing apparatus and a printing method that suppress generation of density unevenness caused by an oblique motion of a print medium.

2. Description of the Related Art

There is known a method of printing an image on a print medium by scanning a predetermined printing area (band) by one time or plural times (one pass or multi-pass) while conveying the print medium in a printing apparatus. According to this printing method, there are some cases where a streak-shaped density unevenness (hereinafter, called "a connecting streak") is generated in a connecting section between the predetermined printing areas due to an error of a conveyance amount of the print medium or the like.

For suppressing generation of this connecting streak, Japanese Patent Laid-Open No. 2007-190861 discloses an image forming apparatus in which a density changing amount is found from a conveyance error of a print medium and a pitch between print elements and γ processing using a correction γ value is executed to image data corresponding to print elements positioned in both ends of the print medium in a conveying direction, based upon this density changing amount. In addition, Japanese Patent Laid-Open No. 2012-126016 discloses an inkjet printing apparatus in which a reduction rate in the amount of ink which is ejected on a predetermined area in the vicinity of the boundary between adjacent printing areas is determined based upon a conveyance shift amount of the print medium and an ink amount to reduce the amount of ink.

The configuration of each of the apparatuses disclosed in Japanese Patent Laid-Open No. 2007-190861 and Japanese Patent Laid-Open No. 2012-126016 takes the event that there occurs the error in the conveyance amount of the print medium into account, but does not take the event that there occurs an oblique motion of the print medium at the time of conveying the print medium into account. That is, the conveyance error of the same amount is assumed to occur in the conveying direction, and therefore the correction is made by the same value or the same reduction rate in a main scan direction. In consequence, the connecting streak cannot be appropriately suppressed in a case where there occurs the oblique motion by which the conveyance amount in the conveying direction differs for each area of the print medium

SUMMARY OF THE INVENTION

The present invention provides a printing apparatus and a printing method that suppress occurrence of density unevenness caused by an oblique motion of a print medium.

According to a first aspect of the present invention, there is provided a printing apparatus, including:

a print head for applying ink on a print medium;

a print control unit configured to control the print head to perform a print onto the print medium while moving the print head in a predetermined direction to the print medium;

a conveying unit configured to convey the print medium in a conveying direction crossing the predetermined direction;

an obtaining unit configured to obtain information regarding a conveyance error of conveyance of the print medium in the conveying direction by the conveying unit with respect to each of a plurality of areas of the print medium that are in positions different from each other in the predetermined direction; and an adjusting unit configured to divide a predetermined area of the print medium in accordance with a conveyance error amount indicated by the information in each of the plurality of areas obtained by the obtaining unit into a plurality of correction areas, and to adjust the amount of ink to be applied onto each of the plurality of correction areas lining up in the predetermined direction.

According to a second aspect of the present invention, there is provided a printing method in a printing apparatus including a print head for applying ink on a print medium, and a conveying unit configured to convey the print medium in a conveying direction crossing a predetermined direction, the printing method including the steps of:

obtaining information regarding a conveyance error of conveyance of the print medium in the conveying direction by the conveying unit with respect to each of a plurality of areas of the print medium that are in positions different from each other in the predetermined direction;

adjusting the amount of ink, to divide a predetermined area of the print medium in accordance with a conveyance error amount indicated by the information in each of the plurality of areas obtained by the obtaining step into a plurality of correction areas, and to adjust the amount of ink to be applied onto each of the plurality of correction areas lining up in the predetermined direction; and controlling the print head to perform a print onto the print medium based upon the amount of ink adjusted in the step of adjusting while moving the print head in the predetermined direction to the print medium.

According to the above configuration, the printing area of the print medium in the moving direction of the print head (main scan direction) is divided, and a print duty for each of the divided areas is adjusted in accordance with the conveyance error amount for each of the divided areas. Therefore, even if there occurs the oblique motion by which the conveyance amount differs for each area of the print medium, the print duty can be adjusted in accordance with the conveyance error amount for each area to suppress the density unevenness caused by the oblique motion of the print medium.

Further features of the present invention will become apparent from the following description of exemplary embodiments (with reference to the attached drawings).

BRIEF DESCRIPTION OF THE DRAWINGS

FIG. 13 is a diagram showing an example of a table for selecting a mask;

FIG. 14 is a diagram showing a different example of a table for selecting a mask;

DESCRIPTION OF THE EMBODIMENTS

Hereinafter, embodiments of the present invention will be in detail explained with reference to the accompanying drawings.

First Embodiment

Figure 1:
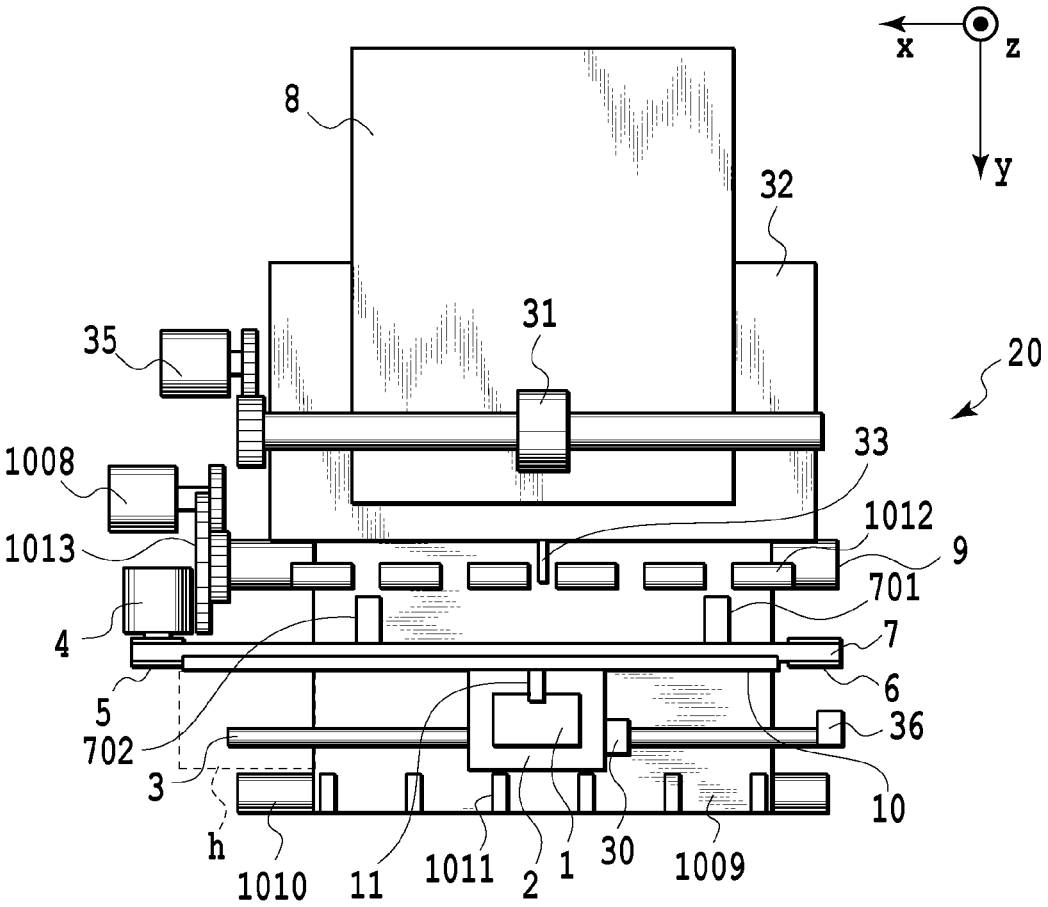
FIG. 1 is a schematic top view showing the internal configuration of a printing apparatus.
Figure 2:
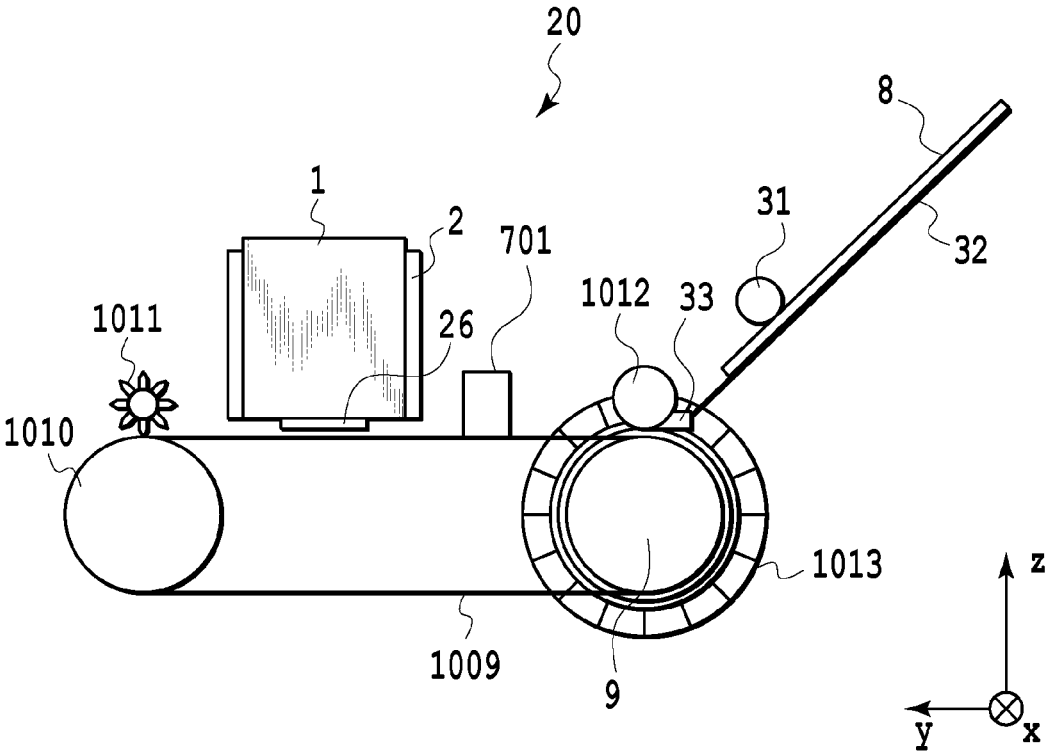
FIG. 2 is a schematic side view showing the internal configuration of the printing apparatus.

FIG. 1 is a schematic top view showing the internal configuration of a printing apparatus 20. FIG. 2 is a schematic side view showing the internal configuration of the printing apparatus 20. As shown in these figures, the printing apparatus 20 is provided with a sheet feeder 32, a conveying belt 1009, a carriage 2, measuring devices 701, 702, and the like.

Print mediums 8 are loaded on the sheet feeder 32. A pickup roller 31 is arranged in a position having the print medium 8 between the sheet feeder 32 and the pickup roller 31. The pickup roller 31 is rotated by a supply motor 35 to separate the print mediums 8 loaded on the sheet feeder 32 one by one, and the separated medium 8 is supplied in a conveying/sub scan direction (y direction in the figure). A sheet detector 33 shown in FIG. 1 detects the print medium 8 supplied from the sheet feeder 32.

The conveying belt 1009 is a sheet-shaped carrier wound around a drive roller 9 and a driven roller 1010 rotated by rotation of the drive roller 9. The print medium 8 is conveyed in a y direction by rotation of the conveying belt 1009 caused by rotation of these rollers. The drive roller 9 is rotated by a conveying motor 1008. In the present embodiment, a conveying unit that conveys the print medium 8 is configured of these components.

The print medium 8 is adsorbed by the conveying belt 1009, for example, the electrostatic adsorption, and the driving force is transmitted without losses. The electrostatic adsorption is realized by attaching not only a feeder roller (not shown) giving electric charge to the conveying belt 1009 but also a neutralization roller (not shown) controlling an electric charge state or the like. The conveyance amount of the conveying belt 1009 can be detected by a rotary encoder 1013 attached to a rotary shaft of the drive roller 9. A control unit (not shown) controls rotation of the conveying motor 1008 based upon this detection amount.

A pinch roller 1012 and a spur roller 1011 are driven rollers for performing a stable conveyance of the print medium by interposing the print medium between each of the rollers 1012, 1011 and the conveying belt 1009.

The carriage 2 is guided/supported by a guide shaft 3, and reciprocates in a main scan direction (x direction in the figure) . The movement of the carriage 2 is performed by a carriage conveying mechanism composed of a carriage motor 4, a pulley 5, a pulley 6 and a timing belt 7.

The carriage 2 is controlled to wait in a position of a home position h shown in a dotted line in the figure when the printing apparatus 20 is not performing a print operation or performs a recovery operation of the print head. The carriage 2 reciprocally moves between the home position h and a back position that is a position opposed to the home position h. As shown in the same figure, the moving direction of the carriage 2 crosses the conveying direction of the print medium 8.

A head cartridge 1 is removably mounted on the carriage 2. The head cartridge 1 is provided with print heads and ink tanks. The print head is provided with a plurality of ejection openings arranged thereon for ejecting ink, and ink is accommodated in the ink tank. Ink is supplied from the ink tank to the print head. The print head is provided with a plurality of print elements, and the print element includes an ejection energy generating element, an ejection opening and a flow passage communicating with the ejection opening.

In the present embodiment, a heater resistance element (heater) is used as the ejection energy generating element. The heating of the heater causes air bubbles to be generated for ejecting ink from the ejection opening. It should be noted that the ejection method of ink may be a method using a piezo element, a method using an electrostatic element, a method using an MEMS element or the like. In the present embodiment, inks of cyan, magenta and yellow are used, but the ink colors used in the printing apparatus 20 are not limited to these kinds.

A sensor 30 and a shield plate 36 are provided to detect that the carriage 2 is in a home position. In the present embodiment, a linear encoder is used to detect a position of the carriage 2 in the x direction. The linear encoder is configured of a linear scale 10 and a detecting sensor 11. In the present embodiment, the linear scale 10 is formed integrally with the guide shaft 3, and the detecting sensor 11 is fixed to the carriage 2. When the detecting sensor 11 obtains position information from the linear scale 10, the position of the carriage 2 in the x direction is identified.

A conveying operation of the print medium 8 by the conveying belt 1009 driven by the drive roller 9 and a printing operation of ejecting ink from the ejection opening in the print head together with the movement of the carriage 2 are alternately repeated a predetermined number of times to print an image on the print medium 8. It should be noted that the printing operation and the conveying operation are controlled by the aforementioned control unit (not shown). That is, the control unit acts also as a print control unit.

The measuring devices 701, 702 are provided to measure the conveyance amount of the print medium 8, and are each provided with an area sensor. The measuring devices 701, 702 are arranged upstream of the carriage 2 in the y direction. The measuring device 701 and the measuring device 702 are arranged in the same position in the y direction and in different positions in the x direction. As shown in FIG. 1, the measuring device 702 is arranged in the home position h-side, and the measuring device 701 is arranged in the back position side.

In the present embodiment, the two measuring devices are used to calculate an oblique motion amount (oblique motion angle:θ) in a case where there occurs the oblique motion of the print medium 8. That is, the movement amounts of right and left ends of the print medium 8 are individually measured by using the measuring device 701 and the measuring device 702, and the oblique motion direction and oblique motion amount (oblique motion angle:θ) of the print medium 8 are calculated from the difference amount therebetween and a distance between the measuring device 701 and the measuring device 702. The details will be described later.

The printing apparatus 20 is, although not shown, provided with the aforementioned control unit including a CPU, a ROM, a RAM and the like. The operation of the printing apparatus 20 is controlled based upon instructions from the control unit, a host computer connected through an external interface thereto or the like. The CPU controls the printing apparatus 20 comprehensively. The ROM stores therein programs to be executed by the CPU and fixed data necessary for various operations of the print apparatus 20. The RAM is used as a work area of the CPU, a temporal storage area of various reception data and stores various setting data.

The printing apparatus 20 in the present embodiment includes a conveyance amount measuring unit, an oblique motion amount calculating unit (obtaining unit), a division unit, a print duty obtaining unit, a selection unit and an increase/decrease unit.

The conveyance amount measuring unit measures the conveyance amount of the print medium 8 at the time of conveying the print medium 8 by a predetermined conveyance amount by the conveying mechanism. The conveyance amount measuring unit directly measures, for example, the conveyance amount of the print medium 8 or the movement amount of the conveying belt 1009 that adsorbs and conveys the print medium 8. The oblique motion amount calculating unit obtains a conveyance error amount that is a difference between the conveyance amount measured by the conveyance amount measuring unit and a desired conveyance amount. The oblique motion amount calculating unit has a function of calculating an oblique motion amount (for example, an oblique motion angle) by obtaining conveyance amounts of the right and left ends of the print medium 8 as conveyance errors.

The division unit divides a correction area on the print medium into a plurality of areas based upon the oblique motion amount. The print duty obtaining unit obtains the ink amount (print duty) to be applied on the area in the vicinity of the boundary (connecting part) of the printing areas for each of the divided correction areas.

The selection unit selects a mask used in each of the divided correction areas, based upon the conveyance error amount and the print duty for each of the divided correction areas. Thereby, the amount of ink (print duty) suitable to be applied to the boundary vicinity of the printing areas for each of the divided correction areas is determined. In the present embodiment, a plurality of masks to be described later are stored in the ROM (storage unit), and the mask is selected based upon the conveyance error amount and the print duty.

The increase/decrease unit (adjusting unit) uses the mask selected by the selection unit to execute the processing that increases/decreases the amount of ink to be ejected to the boundary vicinity. Thereby, the print duty can be adjusted in accordance with the conveyance error amount and the print duty.

It should be noted that in the present embodiment, the explanation will be made of the configuration of the printing apparatus 20 provided with the conveyance amount measuring unit, the oblique motion amount calculating unit, the division unit, the print duty obtaining unit, the selection unit, and the increase/decrease unit, but these units may be not provided in the printing apparatus 20 itself. For example, the conveyance amount of the print medium 8 may be measured by an external device and the printing apparatus 20 may obtain information regarding this measured conveyance amount.

The measurement of the conveyance amount in the conveyance amount measuring unit will be explained. The area sensors (measuring devices 701, 702 in the present embodiment) are arranged in passing positions of the print medium 8 or the conveying belt 1009 adsorbing and conveying the print medium 8, and photograph a surface of the print medium 8 or a surface of the conveying belt 1009 at predetermined timing. A pattern as a sign is in advance printed on the surface of the print medium 8, or patterning is performed on the surface of the conveyance belt 1009. This pattern or patterning is imaged by the area sensors. The movement amount of the image shot by a predetermined time interval is calculated by image processing to calculate the movement amount of the print medium 8 or conveying belt 1009.

In this configuration, the conveyance amount of the print medium 8 or the movement amount of the conveying belt 1009 for performing formation of the image finally can be directly detected. As a result, this detected conveyance amount or movement amount is not subjected to an influence of variations in drive roller diameter, variations in slippage between the print medium 8 and the drive roller 9, and variations in thickness of the conveying belt 1009. Therefore, the conveyance error amount can be accurately calculated from a difference between the detected conveyance amount and the desired conveyance amount.

The other example of the conveyance amount measuring unit may include a device that detects the movement amount of the print medium from a speckle pattern used in a general laser mouse or the like. In addition, a laser Doppler speedometer may be used. The movement distance measurement using the laser Doppler speedometer is a well-known technology, and therefore the explanation is omitted herein.

The conveyance error amount is calculated by figuring out a difference amount between a desired conveyance amount found from a drive amount of the drive roller 9 and an accurate movement amount measured by the conveyance amount measuring unit. For example, the conveyance error amount can be calculated by figuring out a difference amount between a conveyance target amount in accordance with the drive amount of the drive roller 9 and the above movement amount at a conveyance completion time. In addition, for obtaining the conveyance error amount during the conveying, the difference amount between the desired conveyance amount calculated from the drive amount of the drive roller 9 and the accurate movement amount measured by the conveyance amount measuring unit may be figured out.

There are some cases where since a mask is selected to find a conveyance error amount after the conveyance completion in the former configuration, a throughput in the printing apparatus 20 is reduced on some degree. However, in a case of finding the conveyance error amount from a difference amount between the movement amount at a conveyance completion time and the conveyance target amount, a final movement amount of conveyance at the conveyance completion time is used to calculate the conveyance error amount. Therefore, it possible to obtain the conveyance error amount more accurately.

In the latter configuration, it is possible to determine the increase/decrease rate of the ink amount by using the conveyance error amount at timing before conveyance completion, and therefore, the correction of the print data can be made during the conveyance completion to avoid a reduction in the throughput in the printing apparatus 20. In this case, the shift of the conveyance amount generated during a period from a point of imaging by the final area sensor in the conveyance to a point of the conveyance completion remains as an error, but this error can be reduced by setting the imaging timing of the area sensor to timing close to the conveyance completion.

Figure 3:
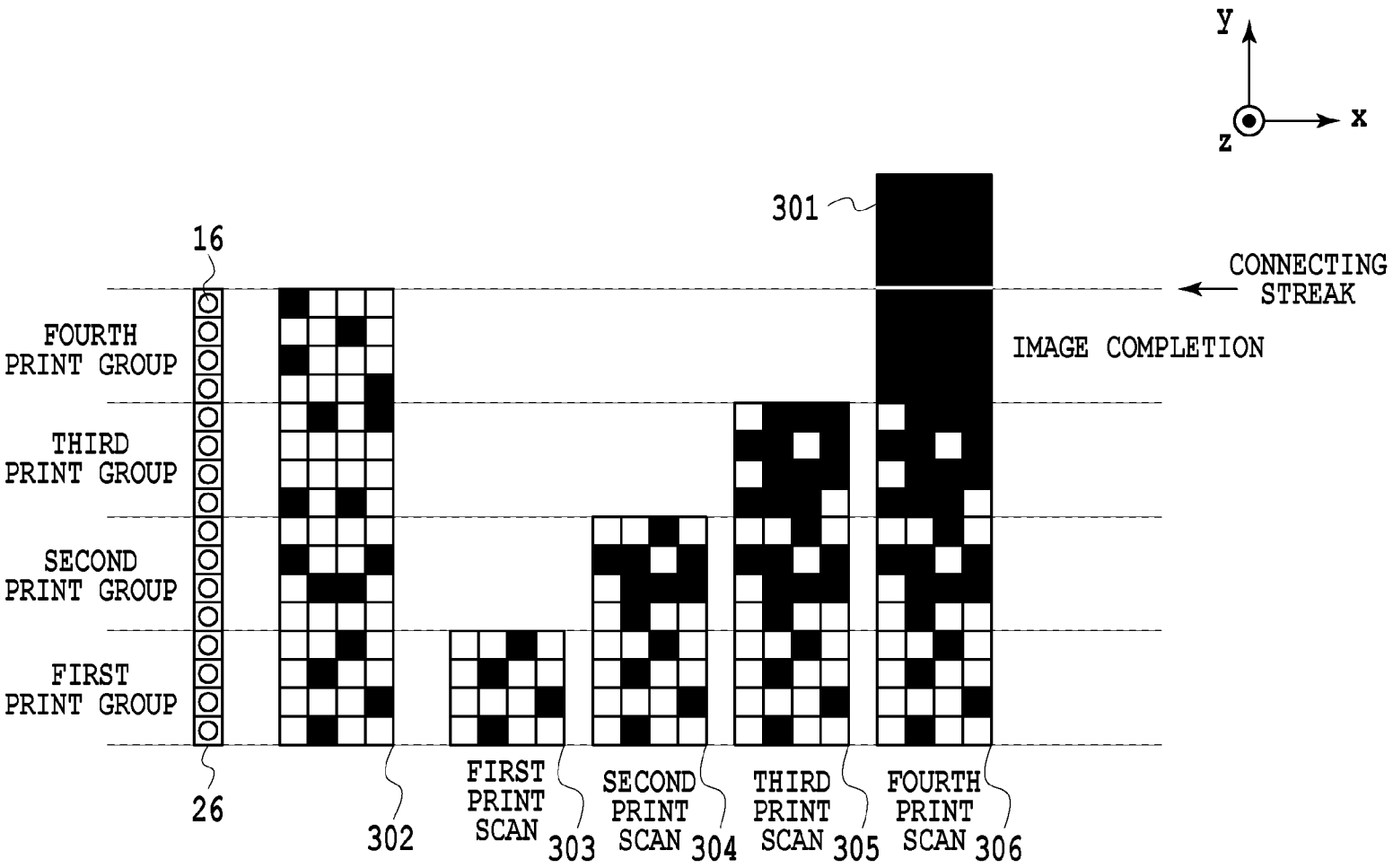
FIG. 3 is a diagram explaining a multi-pass print.

FIG. 3 is a diagram explaining a multi-pass print, and shows diametrically an ejection opening surface of a print head, masks and an image to be printed for explaining a multi-pass print method and the data processing. It should be noted that in this figure, ejection openings of one print head 26 alone are shown, but in a case of using a plurality of print heads, similar ejection openings are provided also in the other print heads. In addition, an example of the print head having one ejection opening array configured of 16 ejection openings will be explained, but the number of the ejection openings and the number of the ejection opening arrays provided in the print head are not limited thereto.

As shown in FIG. 3, the ejection openings are divided into four ejection opening groups each having four ejection openings. Herein the ejection openings are divided into first print group to fourth print group from the upstream side to the downstream side in the conveying direction. In mask 302, black sections show pixels allowing printing. In mask 302, outline sections show pixels not allowing printing. An AND operation of mask 302 and print data is performed to generate ejection data to be printed in each scan. Patterns printed by the respective ejection opening groups have a complementary relationship to each other, and a print of an area corresponding to an area of 4×4 pixels is completed by overlapping these patterns.

First, in a first print scan, a pattern 303 is printed using ejection openings in the first print group. After the printing of the pattern 303, this print area is conveyed in the y direction. In a second print scan, a pattern 304 is printed using ejection openings in the second print group, and this print area is conveyed.

Similarly, in a third print scan, a pattern 305 is printed using ejection openings in the third print group, and this print area is conveyed in the y direction. In a fourth print scan, a pattern 306 is printed using ejection openings in the fourth print group to complete an image. Herein, the printing of the image in a predetermined area (band) of the print medium is completed by four times of print scans (four passes).

Figure 4A:
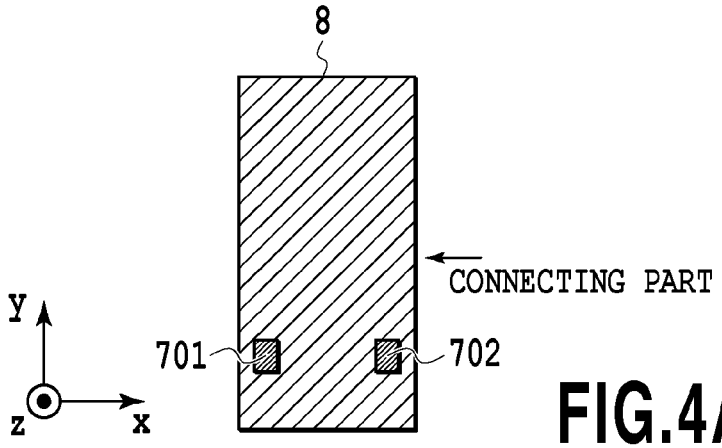
FIG. 4A is a diagram explaining a connecting streak.
Figure 4B:
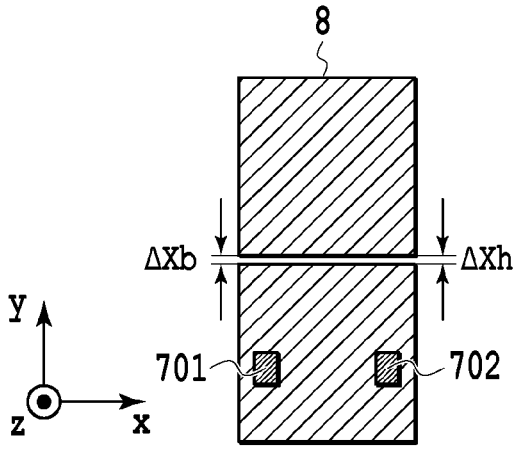
FIG. 4B is a diagram explaining the connecting streak.
Figure 4C:
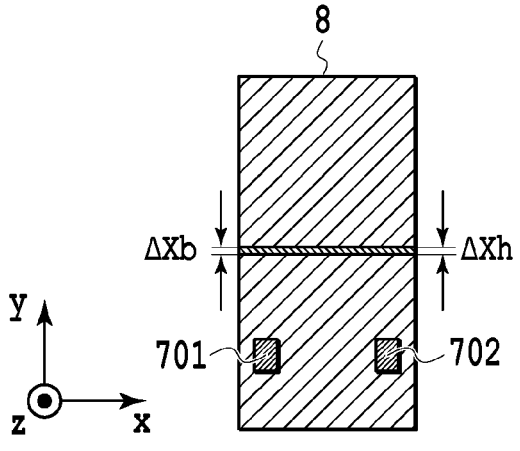
FIG. 4C is a diagram explaining the connecting streak.

Next, an explanation will be made of a conveyance error of the print medium 8 and a connecting streak caused by the conveyance error. FIGS. 4A to 4C are diagrams explaining the connecting streak. FIG. 4A shows a state where a conveyance amount is a desired conveyance amount, and a connecting streak is not generated without a conveyance error. FIG. 4B shows a state where a conveyance amount is longer than a desired conveyance amount, and a connecting streak is generated. FIG. 4C shows a state where a conveyance amount is shorter than a desired conveyance amount, and a connecting streak is generated.

In addition, FIGS. 4B and 4C each show a state where an oblique motion of the print medium 8 is not generated, and the conveyance amount measured by the measuring device 701 is equal or substantially equal to the conveyance amount measured by the measuring device 702.

As shown in FIGS. 4B and 4C, when there occurs an error in the conveyance amount, streak-shaped density unevenness (connecting streak) is generated in an area (connecting part) between one band and the other band adjacent thereto. As shown in FIG. 4B, when an unexpected blank or the like is generated between the area where the image is already completed and the next image in a case where the conveyance amount of the print medium 8 is longer that the desired conveyance amount, thus generating a section (white streak) that is lower in density than the other area. On the other hand, as shown in FIG. 4C, in a case where the conveyance amount of the print medium 8 is shorter than the desired conveyance amount, the next image or the like is printed on the area where the image is already completed to generate a section (black streak) that is higher in density than the other area.

Figure 5A:
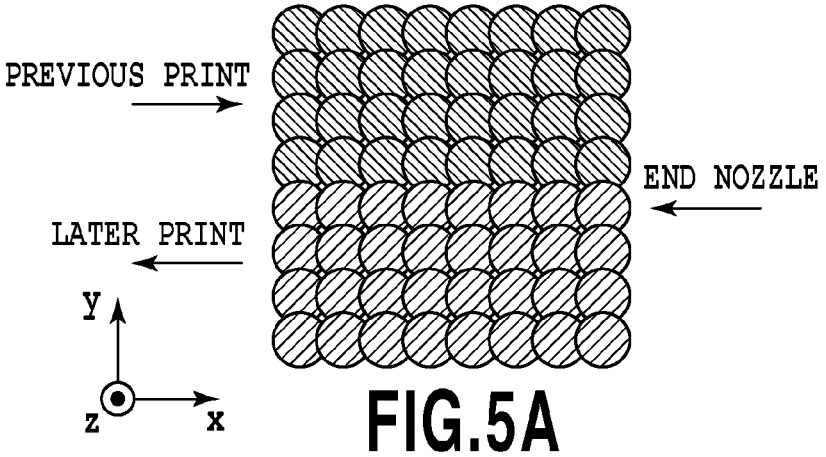
FIG. 5A is a diagram explaining processing for suppressing the connecting streak.

Here, an outline of the processing of reducing the connecting streak will be explained with reference to FIGS. 5A to 5C. FIG. 5A shows an arrangement of dots in a case where the conveyance amount of the print medium 8 is the desired conveyance amount and there is no conveyance error. In this case, the correction is not made because of no generation of the connecting streak.

Figure 5B:
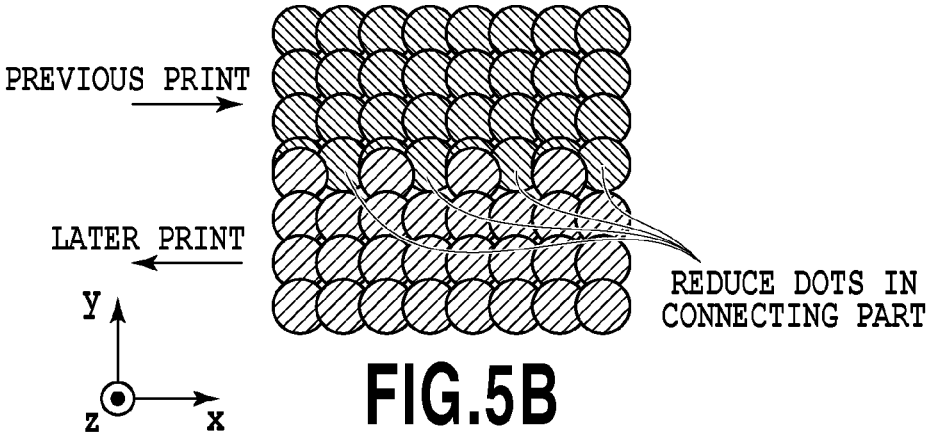
FIG. 5B is a diagram explaining processing for suppressing the connecting streak.
Figure 5C:
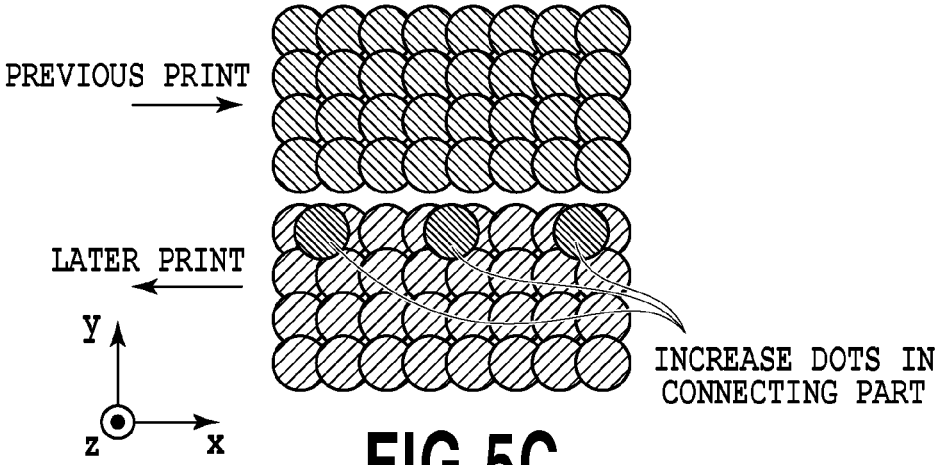
FIG. 5C is a diagram explaining processing for suppressing the connecting streak.

FIG. 5B shows correction processing to a state where the conveyance amount of the print medium 8 is shorter than the desired conveyance amount, and a black streak is possibly generated. As shown in FIG. 5B, in a case where the black streak is possibly generated, the processing of decreasing the dots to be applied to the vicinity of the connecting part is executed to suppress the connecting streak. FIG. 5C shows correction processing to a state where the conveyance amount of the print medium 8 is longer than the desired conveyance amount, and a white streak is possibly generated. As shown in FIG. 5C, in a case where the white streak is possibly generated, the processing of increasing the dots to be applied to the vicinity of the connecting part is executed to suppress the connecting streak.

[Obtainment of Conveyance Amount]

Figure 6:
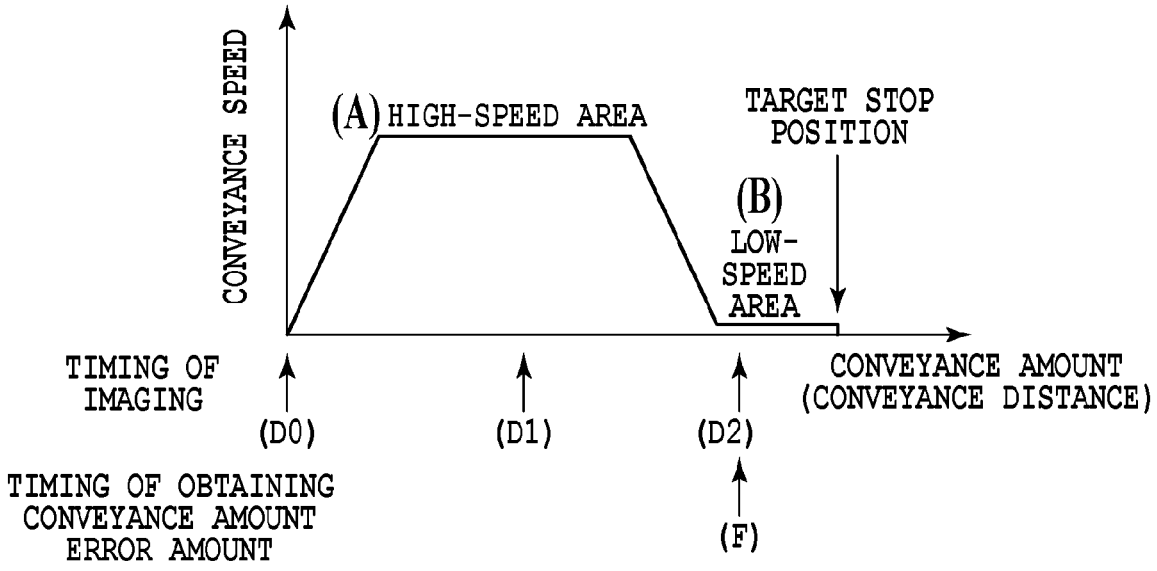
FIG. 6 is a graph showing imaging timing of a sensor and calculation timing of a conveyance amount.

FIG. 6 is a graph explaining imaging timing (D0 to D2) of the area sensor in the measuring devices 701 and 702 for measurement of a movement amount and calculating timing (F) of a conveyance amount. The imaging to be explained hereinafter and calculation of a conveyance amount based upon the imaging will be performed in the conveyance of the print medium 8 in a range corresponding to one band.

First, the imaging by the area sensor is performed before starting the conveyance of the print medium 8 (D0). The control of the conveying motor 1008 driving the drive roller 9 is performed to start the conveyance. After this start, the conveying speed increases, which becomes substantially constant at predetermined timing (high-speed area in the figure). At predetermined timing D1 in the constant speed section, the imaging by the area sensor and the calculation of the conveyance amount are performed.

On this occasion, the measuring devices 701 and 702 perform a known image processing calculation such as cross-correlation processing about the image imaged at timing D0 and the image imaged at timing D1 to calculate the conveyance amount.

In the present embodiment, the imaging (D2) by the area sensor, calculation of the conveyance amount and calculation (F) of the conveyance error amount are performed in the latter part of the conveyance. Image processing such as cross-correlation processing is performed about the image imaged at timing D1 and the image imaged at timing D2 to calculate the conveyance amount from timing D1 to timing D2. In addition, a sum of two conveyance amounts that have been calculated so far is figured out to obtain the conveyance amount from start (D0) of the conveyance to timing D2. At the same timing (F), the conveyance amount by the rotary encoder 1013 is found and a difference amount therebetween is figured out to calculate a conveyance shift amount.

Further, herein an oblique motion (oblique motion angle:θ) of the print medium 8 is calculated from a conveyance error amount between the right and left ends of the print medium 8 and a distance between the measuring device 701 and the measuring device 702.

In the present embodiment, the conveyance shift generated from the timing D2 to the conveyance completion is not corrected. Therefore, it is desired that timing D2 is in a possibly rear part for further reducing the connecting streak due to the conveyance error. On the other hand, for the purpose that the conveyance error amount is calculated before the conveyance completion, the correction processing to the connecting streak to be described later is executed, and a reduction of the throughput due to the connecting streak correction processing is avoided, it is necessary to secure a constant time from the conveyance completion for timing D2. Timing D2 is determined in consideration of these points.

Figure 7:
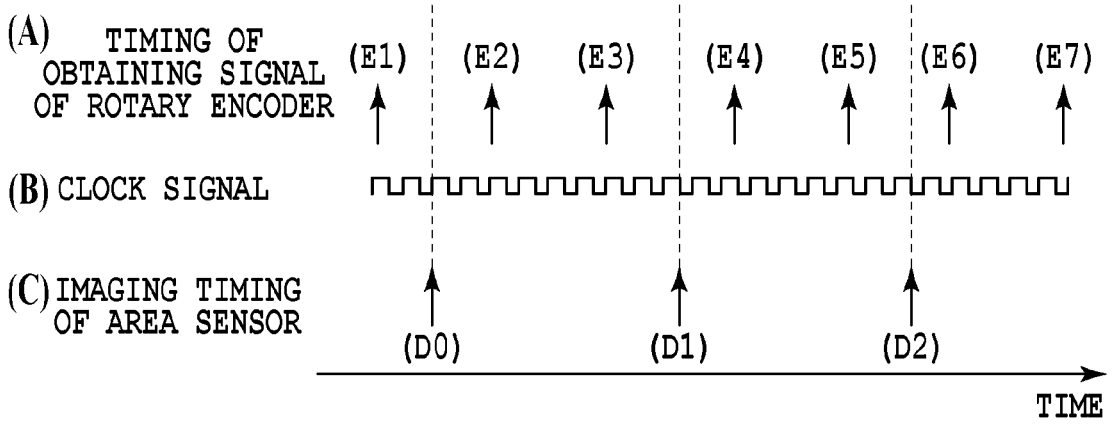
FIG. 7 is a diagram explaining obtainment of a conveyance amount by a rotary encoder.

FIG. 7 is a diagram explaining obtainment of a conveyance amount by the rotary encoder 1013. The aforementioned conveyance amount measuring unit includes the rotary encoder 1013 and a count unit. The count unit counts slit passing signals of the rotary encoder 1013. This count unit obtains count values at predetermined timings (E1) to (E7) to find a conveyance amount. FIG. 7 shows timings of obtaining conveyance amounts by the rotary encoder 1013, as well as imaging timings (D1) and (D2) by the area sensors in the measuring devices 701, 702.

In the present embodiment time, time shifts between the imaging timing (D1) by the measuring devices 701, 702 and timings (E1) and (E2) of obtaining the measured value by the rotary encoder are obtained based upon clock signals (B) shown in FIG. 7. In addition, the time shift amount is used to perform an internal division calculation based upon the measured values (count values) by the rotary encoder 1013 at the timings (E1) and (E2), thus calculating the measured value at timing (D1) by the rotary encoder 1013. Similarly, the measured value at timing (D2) by the rotary encoder 1013 is calculated.

In addition, when a difference amount between the measured value of the rotary encoder 1013 at timing (D2) and the measured value of the rotary encoder 1013 at timing (D1) is figured out, the conveyance amount between timing (D1) and timing (D2) by the rotary encoder 1013 can be obtained.

The conveyance amount by the rotary encoder 1013 contains the shift from an actual conveyance amount of the print medium 8 due to variations in a roller diameter of the drive roller 9, variations in thickness of the conveying belt 1009, and the like. On the other hand, the conveyance amount measured by the measuring devices 701, 702 is a conveyance amount in accordance with the actual conveyance amount with higher accuracy without being influenced by variations in a roller diameter of the drive roller 9 or variations in thickness of the conveying belt 1009. In the present embodiment, a difference amount between the conveyance amount measured by the rotary encoder 1013 and the conveyance amount measured by the measuring devices 701 and 702 is figured out to obtain the conveyance error amount.

It should be noted that the method for obtaining the conveyance amount by the rotary encoder 1013 is not limited to the method explained above. In timing close to the imaging timing by the area sensor, the conveyance amount by the rotary encoder 1013 is only required to be obtained. For example, in a case where the timing of obtaining the conveyance amount by the rotary encoder 1013 is sufficiently fast, a value of the timing of acquiring the conveyance amount by the rotary encoder 1013 that is the closest to the imaging timing from timing (D0) to timing (D1) may be used.

[Obtainment of Position of Carriage 2]

In the present embodiment, the correction area is divided in the main scan direction in a print in a range corresponding to one scan (called also one scan), and on top of that, the amount of ink (print duty) is adjusted in accordance with a conveyance error amount of each area to suppress the density unevenness. Therefore, in the present embodiment, a position of the carriage in the main scan direction is found accurately. Here, as explained with reference to FIG. 1, a linear encoder is used to obtain a position of a carriage 2 in the main scan direction.

[Correction Processing to Connecting Streak]

Figure 8:
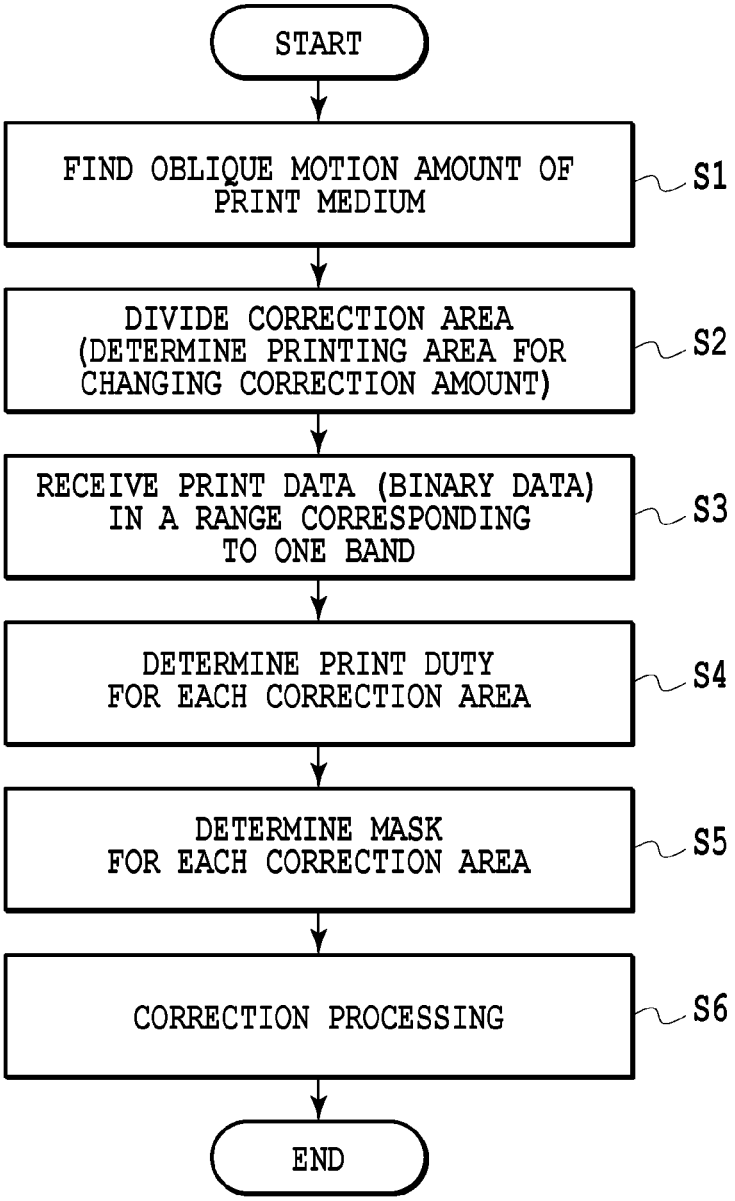
FIG. 8 is a flowchart showing a flow of correction processing in a first embodiment.

FIG. 8 is a flow chart showing a flow of correction processing in the present embodiment. This correction processing is activated when the conveyance operation for completing an image on a predetermined printing area (band) is completed, and is executed for each one band.

<Calculation of Oblique Motion Angle as Oblique Motion Amount of Print Medium 8 (Step S1)>

Figure 9A:
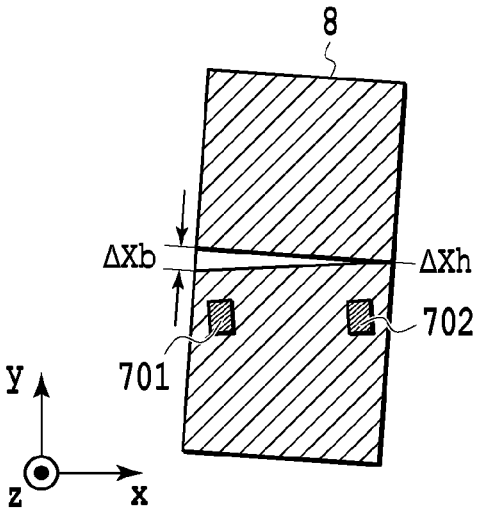
FIG. 9A is a diagram explaining a connecting streak in a case where an oblique motion occurs.
Figure 9B:
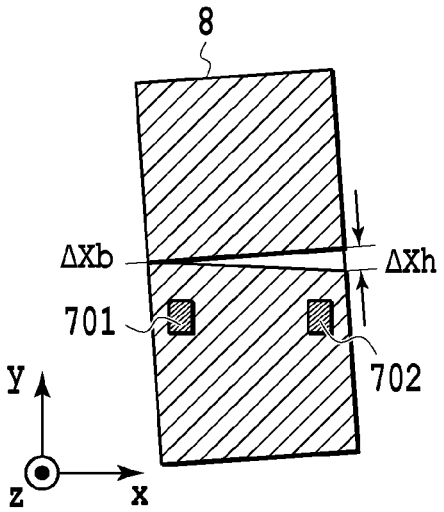
FIG. 9B is a diagram explaining a connecting streak in a case where an oblique motion occurs.

First, at step S1 an oblique motion amount of the print medium 8 is found. FIGS. 9A to 9D are diagrams explaining a connecting streak in a case where an oblique motion of the print medium 8 occurs. FIGS. 9A and 9B show a state where there occurs a different oblique motion in each position of the conveyance amount of the print medium 8, and white streaks different in degree occur in the right and left ends of the print medium 8 in the x direction. FIG. 9A shows a case where a conveyance amount measured by the measuring device 701 is longer than a conveyance amount measured by the measuring device 702, and FIG. 9B shows a case where a conveyance amount measured by the measuring device 702 is longer than a conveyance amount measured by the measuring device 701.

Figure 9C:
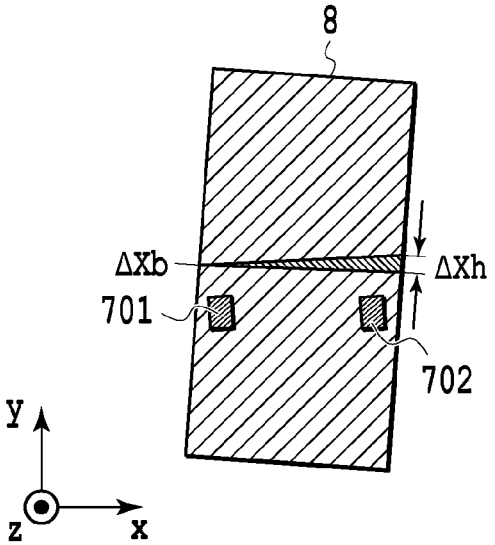
FIG. 9C is a diagram explaining a connecting streak in a case where an oblique motion occurs.
Figure 9D:
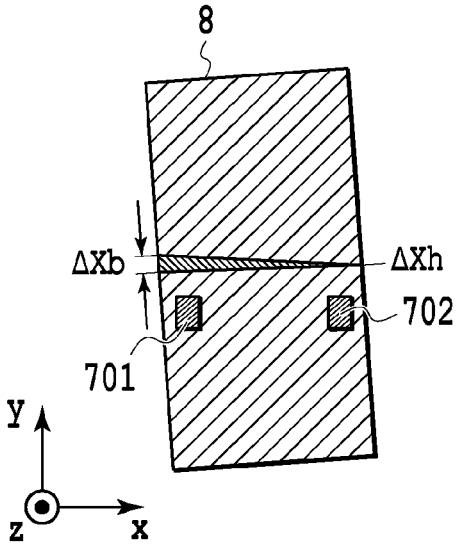
FIG. 9D is a diagram explaining a connecting streak in a case where an oblique motion occurs.

FIGS. 9C and 9D show a state where there occurs a different oblique motion in each position of the conveyance amount of the print medium 8, and black streaks different in degree occur in the right and left ends of the print medium 8 in the x direction. FIG. 9C shows a case where a conveyance amount measured by the measuring device 702 is shorter than a conveyance amount measured by the measuring device 701, and FIG. 9D shows a case where a conveyance amount measured by the measuring device 701 is shorter than a conveyance amount measured by the measuring device 702.

As shown in FIGS. 9A to 9D, when an oblique motion of the print medium 8 occurs, the degree of the connecting streak (size of an area where the streak occurs) differs for each area in the x direction even if the position in the y direction is in the same area. Therefore, in the present embodiment, the oblique motion amount of the print medium 8 is found, the correction area is divided into a plurality of areas and the correction is made to the connecting streak for each area. FIGS. 9A to 9D show a case where the oblique motion occurs at the time of printing a unit area, and show a case where the oblique motion does not occur on the area printed before printing this unit area.

In FIGS. 9A to 9D, the conveyance amount measured by the measuring device 701 is indicated at distance Xb, and the conveyance amount measured by the measuring device 702 is indicated at distance Xh. A desired conveyance amount is indicated at Xa, a difference amount between distance Xh and distance Xa is indicated at ΔXh, and a difference amount between distance Xb and distance Xa is indicated at ΔXb. A difference amount between ΔXh and ΔXb is indicated at ΔX, and a print width in the main scan direction (x direction) is indicated at L.

In FIG. 9B, distance Xh and distance Xb are longer than distance Xa, and ΔXh is longer than ΔXb. In addition, each of distance Xh and distance Xb is a sum of an integrated value of conveyance error amounts in the respective passes from first pass to $(n-1)^{th}$ pass and a conveyance error amount of $n^{th}$ pass.

This relation is represented by the following formulas.

$$\Delta Xh = Xh - Xa \quad \text{(Formula 1)}$$

$$\Delta Xb = Xb - Xa \quad \text{(Formula 2)}$$

$$\Delta X = \Delta Xh - \Delta Xb \quad \text{(Formula 3)}$$

$$\tan\theta = \Delta X/L \quad \text{(Formula 4)}$$

$$\theta = a\tan(\Delta X/L) \times 180/\pi \ (\pi\text{:circular constant}) \quad \text{(Formula 5)}$$

An oblique motion angle θ is calculated from Formula 5.

<Division of Correction Area (Step S2)>

Figure 10:
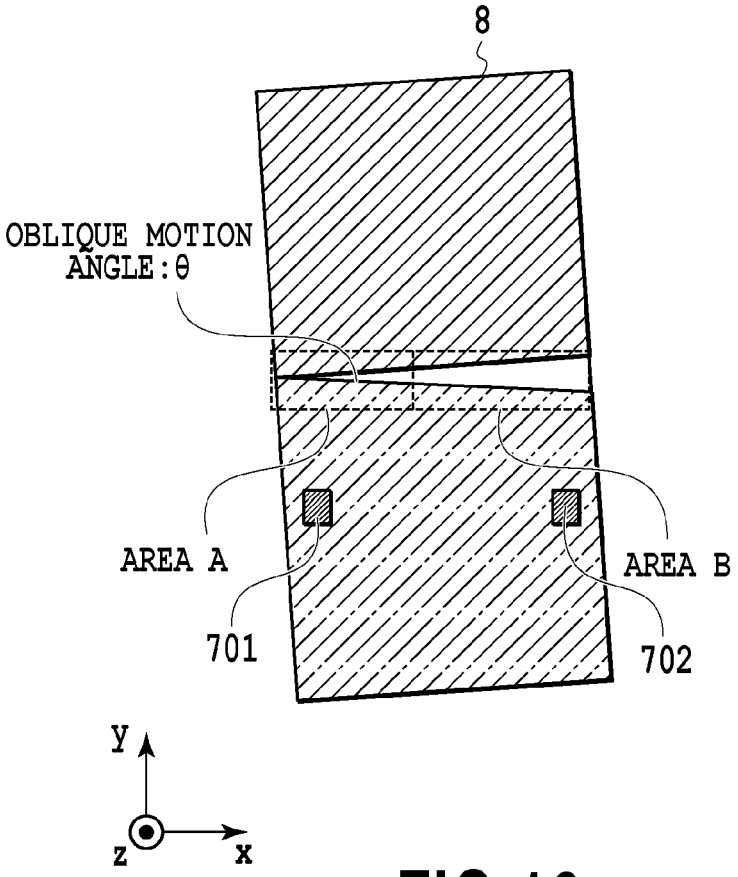
FIG. 10 is a diagram showing a division example of a correction area.

In step S2 the oblique motion angle calculated in step S1 is used to divide a correction area for switching a correction amount in the main scan direction (S2). FIG. 10 is a diagram showing a division example of the correction area, and shows a division example of the correction area in the state shown in FIG. 9B.

It should be noted that in FIG. 10, FIG. 16, FIG. 18 and FIG. 20, a hatched line part of the print medium 8 shows an area where a print is completed, and a doted hatched line part shows an area where a print will be performed from now on. In addition, in the figure, for the descriptive purpose, a white streak is illustrated in outline.

As shown in FIG. 10, when the oblique motion occurs in the middle of conveying the print medium 8, conveyance amounts in both ends of the print medium 8 in the x direction differ. In this way, when the conveyance amount differs and the conveyance error amount differs depending on which position the print position in the x direction is, as to areas each having the same print position in the y direction but having a different print position in the x direction, it is impossible to appropriately correct these areas by the same correction amount.

Therefore, in the present embodiment, the area for the correction is divided into a plurality of areas. In a case shown in FIG. 10, the printing area of the print medium 8 is divided into area A and area B. For example, when the maximum value of the conveyance error in FIG. 10 is assumed to be +15 μm, the correction amount is switched between an area where the conveyance error of +5 μm or less occurs and an area where the conveyance error of more than +5 μm occurs, by a threshold of +5 μm.

A conveyance error amount (ΔXn) in Δ Ln can be found by the following formula 6 from an oblique motion angle θ found by the formula 5 and a distance from the home position h of the carriage 2 (Δ Ln: actual print position).

$$\Delta Xn = \Delta Ln \times \tan\theta \quad \text{(Formula 6)}$$

An area of ΔXn≤+5 μm is area A, an area of ΔXn>+5 μm is area B, and print position Δ Ln for switching a correction amount can be found by the following formula 7.

$$\Delta Ln = \Delta Xn/\tan\theta \quad \text{(Formula 7)}$$

It should be noted that in FIG. 10, an example of dividing the print area into two correction areas is explained, but the correction area may be divided into more than two.

For example, as the oblique motion amount of the print medium 8 is larger, the division number of the correction area may be the larger, and as the oblique motion amount of the print medium 8 is smaller, the division number of the correction area may be the smaller. In a case where the oblique motion amount of the print medium 8 is equal to or larger than a predetermined amount, the correction area is defined as a first area number to be divided more finely, it is possible to suppress the density unevenness more accurately in accordance with a conveyance error amount in each correction area. On the other hand, in a case where the oblique motion amount of the print medium 8 is smaller than the predetermined amount, the correction area is defined as a second area number, and by making the division number of the correction area small, it is possible to suppress a processing load due to frequent switch of masks and to suppress the density unevenness.

<Reception of Print Data of One Scan (Step S3)>

In step 3 print data in a range corresponding to one band is received. This print data is data after quantization (binarization). In the correction processing in the present embodiment, the print data is received without waiting for timing (F) for obtaining the conveyance error amount explained in FIG. 6, and the processing subsequent to step S4 to be described later starts immediately after obtaining the conveyance error amount.

<Determination of Print Duty for Each Correction Area (Step S4)>

In step S4 the print duty is determined for each of the areas divided in step S2. The determination of the print duty is performed by a dot counter for counting dots. In the present embodiment, the print duty is determined for each divided correction area from the conveyance error amount and the print duty in accordance with the print data to be printed.

Figure 11:
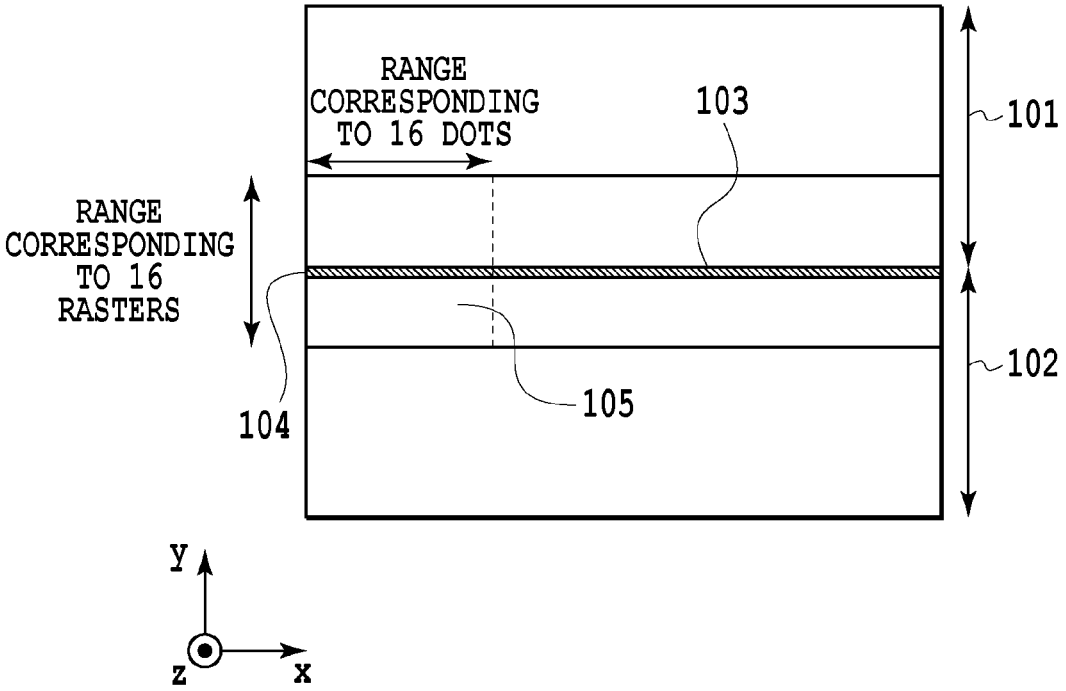
FIG. 11 is a diagram explaining a dot count area in a print medium.

FIG. 11 is a diagram explaining a dot count area 105 in the print medium 8. As shown in this figure, a connecting part 103 that is a band boundary exists between a band 101 previously printed and a band 102 later printed. In the present embodiment, an area of 16 pixels×16 pixels across the connecting part 103 is defined as the dot count area 105. The dot count area 105 is defined as an area wider than the correction area 14 in the y direction, and a printing state of the connecting part 103 can be appropriately recognized by counting dots (binary data) of the band 101 and the band 102 across the connecting part 103.

The dot count is performed for each of the correction areas divided in step S2, and the print duty is determined for each correction area. In addition, the dot count is performed to binary data of every ink color mounted on the printing apparatus 20. A sum of the dot count numbers of the respective colors is set as a dot count value (or total dot count value) as a result of the dot count.

<Determination of Mask for Each Correction Area (Step S5)>

Figure 12:
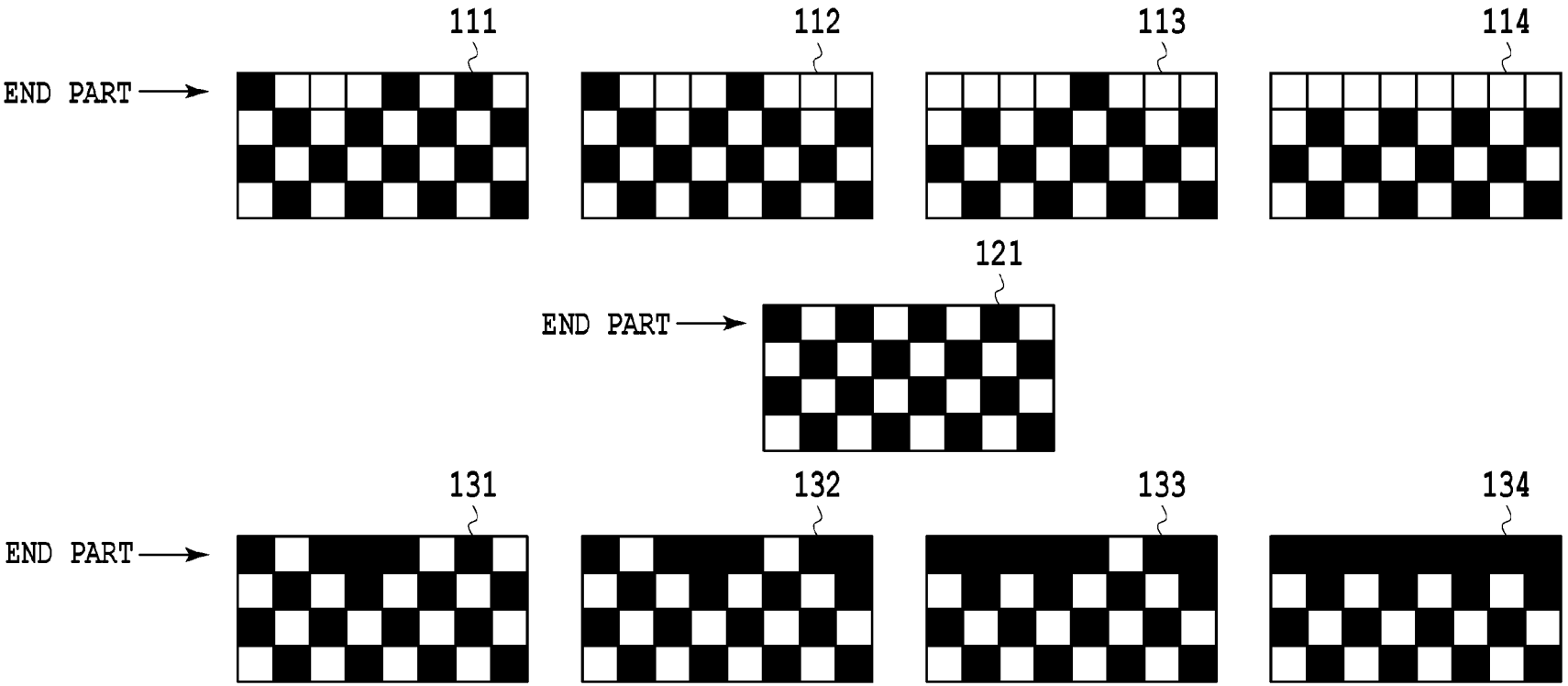
FIG. 12 is a diagram showing examples of masks.

In step S5 masks applied for each correction area are determined. FIG. 12 is a diagram showing an example of masks, and FIG. 13 is a diagram showing an example of a table for selecting masks. In the present embodiment, the table in which a conveyance error amount, a print duty and a mask are associated with each other is in advance stored in a predetermined memory. As shown in FIG. 13, in the present embodiment, a mask to be applied to each correction area is selected from a conveyance error amount and a print duty for each correction area. It should be noted that FIG. 12 shows masks to be used for a two-pass print.

In a case where a conveyance error amount x is equal to or more than −15 μm and less than −5 μm, since the conveyance amount of the print medium 8 is shorter than a desired conveyance amount, a black streak is generated. Therefore, as shown in FIG. 12 and FIG. 13, masks 111 to 114 that reduce dots by an end ejection opening 16 are selected. As shown in FIG. 12, a reduction rate of dots increases in the order of masks 111 to 114. In addition, as shown in FIG. 13, as the print duty is higher, a density of the black streak is possibly the higher. Therefore a mask in which the reduction rate of dots is high is selected.

In a case where the conveyance error amount x is equal to or more than −5 μm and less than +5 μm, the density unevenness is relatively indistinctive. Therefore as shown in FIG. 12 and FIG. 13, in a case where the conveyance error amount is in this range, mask 121 that does not decrease or increase dots by the end ejection opening 16 is used.

In a case where the conveyance error amount x is equal to or more than +5 μm and is equal to or less than +15 μm, since the conveyance amount of the print medium 8 is longer than the desired conveyance amount, a white streak is generated. Therefore, as shown in FIG. 11 and FIG. 12, masks 131 to 134 that increase dots by the end ejection opening 16 are selected. As shown in FIG. 12, an increase rate of dots increases is higher in the order of masks 131 to 134. In addition, as shown in FIG. 13, as the print duty is higher, the white streak is possibly the more distinctive. Therefore a mask in which the increase rate of dots is high is selected.

It should be noted that FIG. 12 shows only the masks in accordance with the area in a range corresponding to four rasters including the end ejection opening 16, but masks that are actually used correspond to the number of the ejection openings. As long as the connecting streak caused by the oblique motion of the print medium 8 can be corrected, only masks (in FIG. 12, masks in a range corresponding to one raster in the end) corresponding to a part necessary for correction are only required to be switched.

In addition, in FIG. 13, the conveyance error amount is set to three steps and the print duty is set to four steps, but accuracy of the correction can be enhanced by setting more divided steps. This setting may be determined based upon securement of a memory area for storing masks, a cost increase of hardware therefor, characteristics of the print medium and the like. In addition, the degree of being capable of recognizing the connecting streak differs depending on kinds of ink colors even in a case of the same conveyance error amount and the same print duty. Therefore it is preferable that a table that differs for each kind of the ink color is produced and a table that differs for each ink color (color of a printing color material) is used.

FIG. 14 is a diagram showing the other example of a table for selecting a mask. In FIG. 13, the mask to be applied to each area is selected from the conveyance amount error and the print duty, but a mask to be applied to each area may be selected from the conveyance amount error only. In this case, the process of step S4 in FIG. 8 is omitted. In a case where determination of the print duty for each correction area is not made, the processing load of performing the dot count for each correction area is reduced. In addition, the processing speed can be faster than in a case of performing the dot count.

<Correction Processing (Step S6)>

In step S6 the correction processing of the connecting streak using the mask selected in step S5 is executed for each of the areas divided in step S2. The correction processing is completed through the above process. Thereby the image in which the connecting streak is reduced can be obtained.

Figure 15:
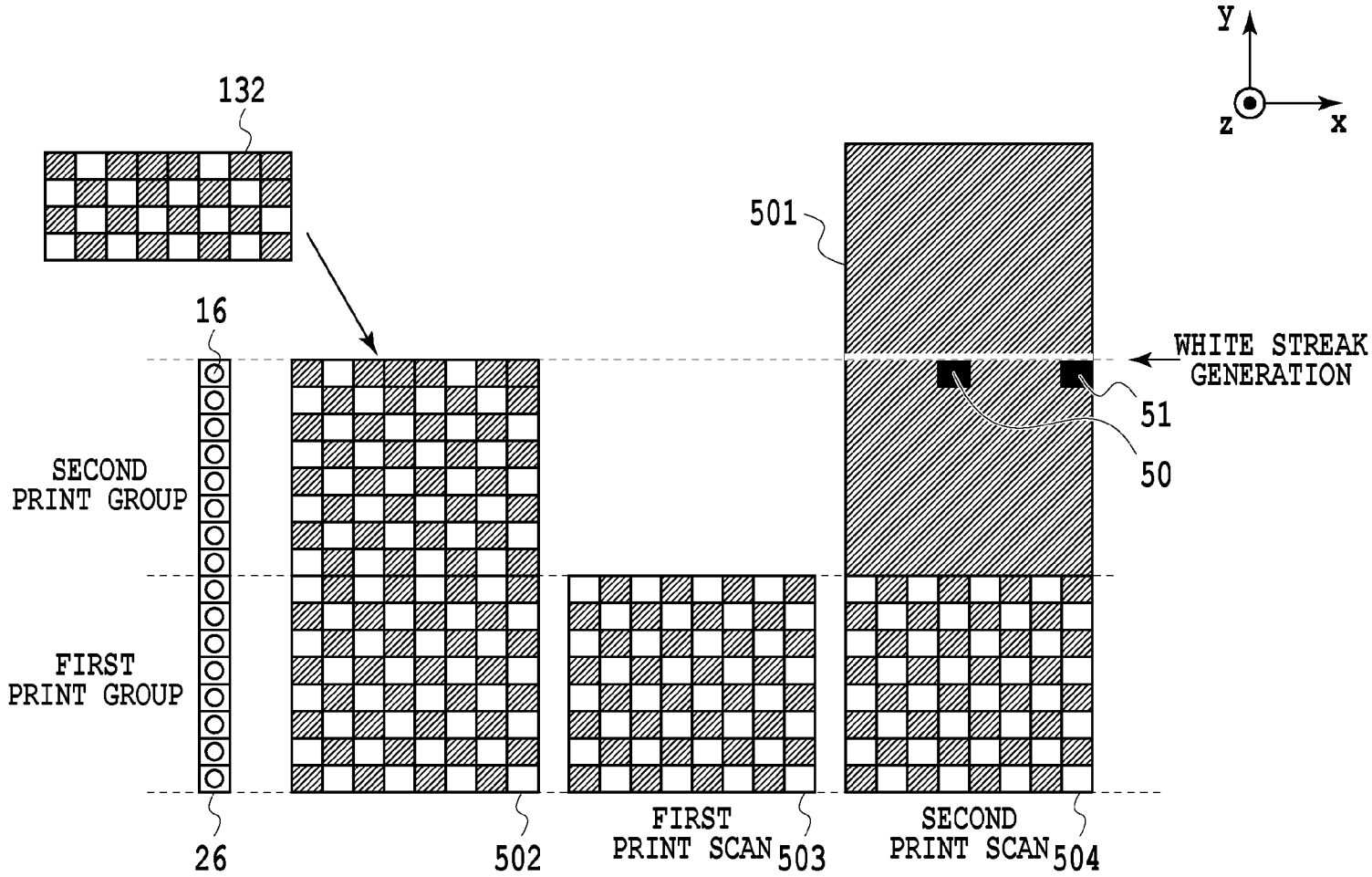
FIG. 15 is a diagram explaining correction using a mask in a two-pass print.

FIG. 15 is a diagram explaining the correction processing using masks in a two-pass print. In FIG. 15, 16 ejection openings configuring one ejection opening array are divided into two groups composed of a first print group and a second print group each having eight ejection openings. In addition, this figure shows a case where it is possible that the white streak is generated.

In a case shown in FIG. 15, mask 132 which increases two dots to be printed by the end ejection opening 16 in a second print scan is used, such that further, dots are applied to locations 50, 51 where the dots were applied in a first print scan. Thereby the degree that the white streak is possibly generated is reduced to reduce the density unevenness between the image 501 already printed and the image to be printed on the next.

It should be noted that mask 132 is used until the next area where the correction amount is switched in the main scan direction. The switching processing of the mask will be explained with reference to FIG. 16.

Figure 16:
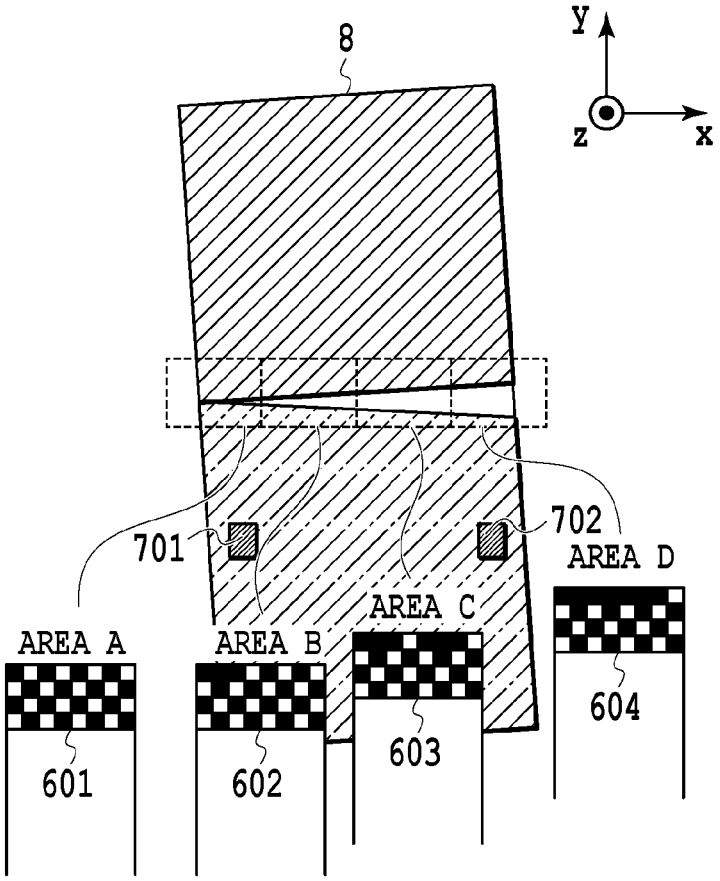
FIG. 16 is a diagram explaining correction of a connecting streak using masks.

FIG. 16 is a diagram explaining a correction of a connecting streak using masks. As described above, in the present embodiment, the mask used for each predetermined area in one scan is switched corresponding to the conveyance error amount and the print duty. Therefore even in a case where the oblique motion of the print medium 8 occurs, the conveyance error amount differs for each area and the degree of the connecting streak differs for each area, it is possible to appropriately suppress the connecting streak.

FIG. 16 shows masks 601 to 604 used for each area in one scan in the two-pass print. In a case shown in FIG. 16, the conveyance error amount increases in the order of areas A to D in a case where the white streak is generated, and the number of printable pixels in a range corresponding to one raster at the end of the mask using in accordance therewith also increases.

It should be noted that in FIG. 16 the correction to the white streak is explained, but the correction can be made by using the mask that reduces the number of printable pixels to the black streak.

In the present embodiment, the method of correcting the connecting streak by switching the mask to be applied for each area is explained, but the correction may be made to multivalued data in accordance with the end ejection opening 16. In addition, the correction may be made to binary data. In this case also, in a case where the oblique motion occurs, the connecting streak can be suppressed by differentiating the correction amount for each area in the x direction in accordance with the conveyance error amount or the like. However, the method of using the mask as described above is a simple method where the processing load is smaller than a method of making a correction to data itself.

Second Embodiment

In the first embodiment, the first raster area in the end is used to correct the connecting streak. However, in a case where the oblique motion amount is large, there are some cases where even if the correction is made using one raster area in the end, the connecting streak cannot be appropriately corrected.

Therefore in the present embodiment, it is selected whether one raster area in the end is used for correction or a plurality of raster areas including one raster area in the end are used for correction, depending on the oblique motion amount. Therefore in the present embodiment, masks for making the correction using one raster area in the end and masks for making the correction using a plurality of raster areas including one raster area in the end are prepared. In addition, tables for selecting these masks each are stored in a predetermined memory. The other configuration is the same as in the first embodiment, and therefore the explanation is omitted herein.

Figure 17:
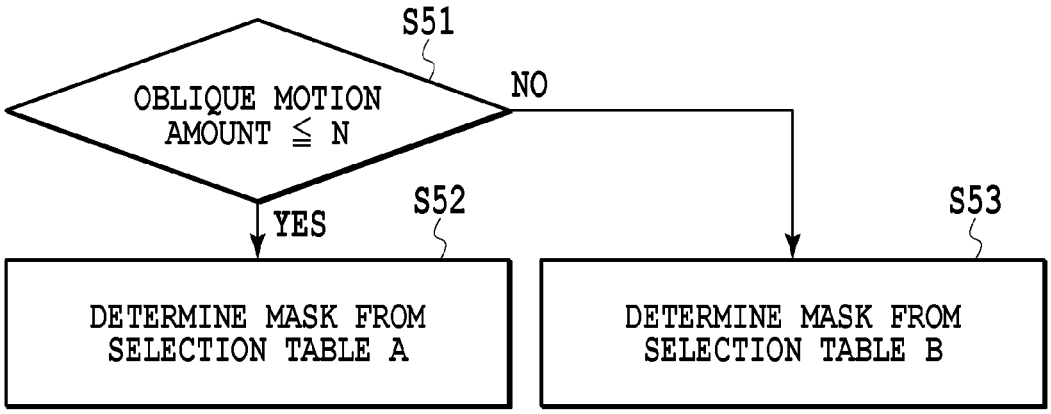
FIG. 17 is a flowchart showing a flow of correction processing in a second embodiment.

FIG. 17 is a flow chart showing a flow of the correction processing in the present embodiment. The flow shown in this figure is executed in step S5 in FIG. 8. Here, the table for selecting masks for making the correction using one raster in the end is indicated at selection table A, and the table for selecting masks for making the correction using a plurality of rasters including one raster in the end is indicated at selection table B.

As shown in FIG. 17, in step S51 it is determined whether or not the oblique motion amount obtained in step S1 shown in FIG. 8 is equal to or less than a preset value (N in FIG. 17). In a case where the oblique motion amount is equal to or less than N, in step S52 the mask used for correction is selected from selection table A. On the other hand, in a case where the oblique motion amount is more than N, in step S53 the mask used for correction is selected from selection table B. Thereafter, the process goes to step S6 in FIG. 8 as described above, wherein the correction processing using the selected mask is executed.

It should be noted that in step S51 an upper limit value of an oblique motion amount that can be corrected is set. In a case where the oblique motion amount exceeds this upper limit value, the print operation may be stopped to provide a warning of a print error to a user.

Figure 18:
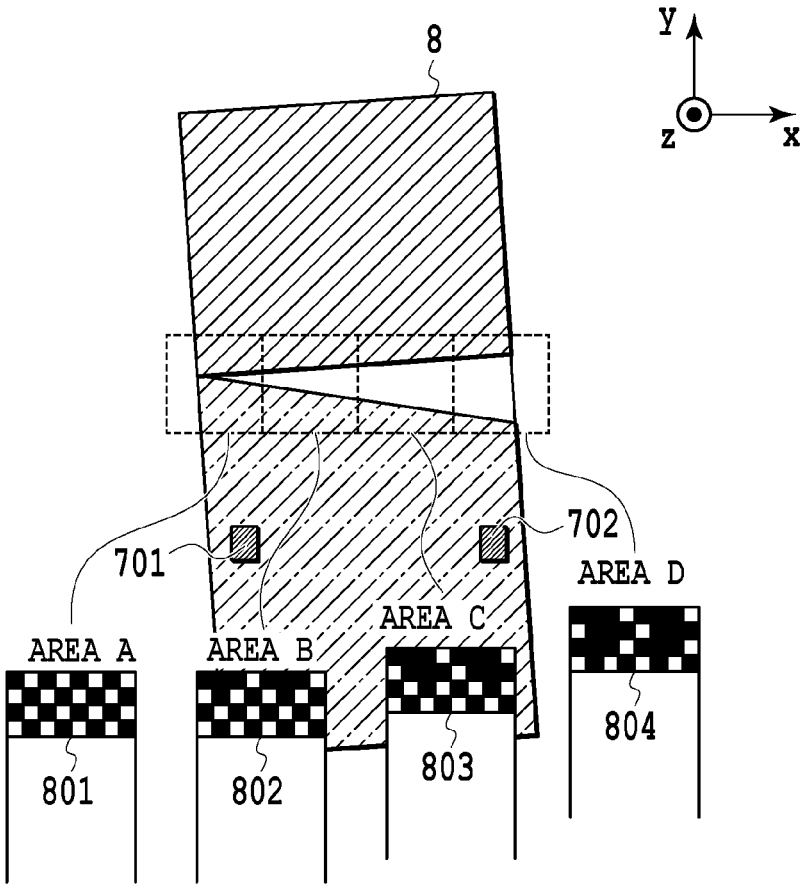
FIG. 18 is a diagram explaining correction of a connecting streak using masks.

FIG. 18 is a diagram explaining the correction of the connecting streak using masks. This figure shows an example where in a case where it is possible that the white streak is generated, the mask in which the raster number used for correction differs for each printing area in the x direction is used in accordance with the oblique motion amount. It should be noted that FIG. 18 also shows, as similar to FIG. 16, masks 801 to 804 used for one scan in a two-pass print. This figure shows a case where a conveyance amount measured by the measuring device 702 is longer than a conveyance amount measured by the measuring device 701 and the white streak is generated.

As shown in FIG. 18, in area A positioned in the measuring device 701-side, mask 801 in which dots are not increased or decreased is used, and in area B adjacent to area A, mask 802 in which dots are increased in number in one raster in the end is used.

In addition, in area C adjacent to area B, mask 803 in which dots are increased in number in two rasters including one raster in the end is used. In area D adjacent to area C and positioned in the measuring device 702-side, mask 804 in which dots are increased in number in three rasters including one raster in the end is used.

In this way, in the present embodiment, a plurality of masks each having a different raster number used for correction are prepared, and these masks are selected as needed in accordance with the oblique motion amount for use. In consequence, also in a case where the oblique motion amount is relatively large, it is possible to appropriately suppress the connecting streak.

Third Embodiment

An explanation will be made of a method in which correction is not made in the central part of the print medium and correction is made in both ends thereof across the central part in the main scan direction. The other configuration is the same as in the first embodiment, and the explanation is omitted herein.

Figure 19:
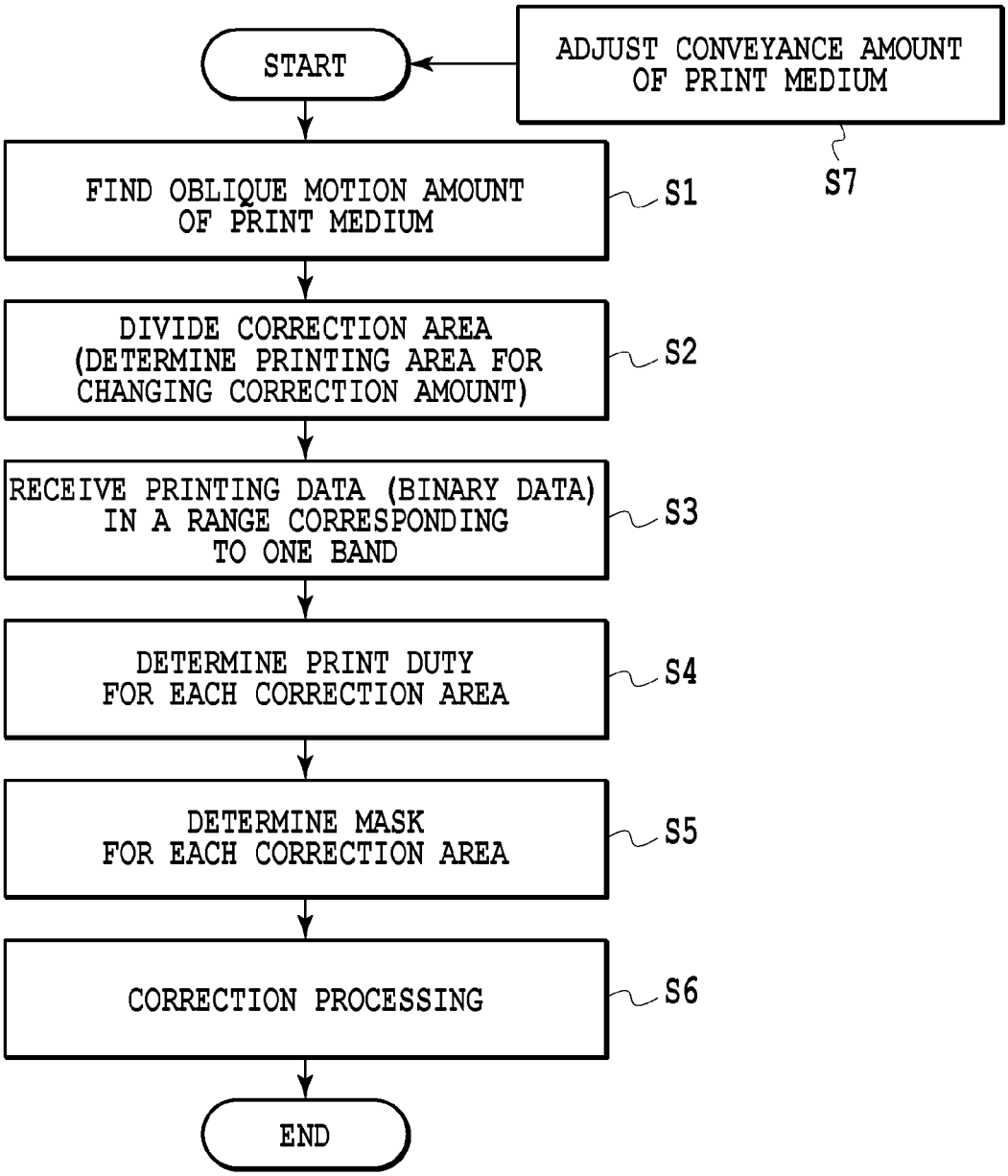
FIG. 19 is a flowchart showing a flow of correction processing in a third embodiment.

FIG. 19 is a flowchart explaining correction processing in the present embodiment. As shown in this figure, in the present embodiment, in order that a connecting streak due to a conveyance error is not generated in the center of the print medium 8, in step S7 the conveyance amount of the print medium 8 is adjusted before starting the correction processing. This adjustment of the conveyance amount of the print medium 8 is performed by controlling rotation of the conveying motor 1008. In a case where the conveyance amount of the pint medium 8 is longer than a desired conveyance amount, the print medium 8 is wound back, and in a case where the conveyance amount of the pint medium 8 is shorter than the desired conveyance amount, the print medium 8 is further conveyed.

The processes of step S1 to step S6 in FIG. 19 are the same as those from step S1 to step S6 in FIG. 8, and therefore the explanation is omitted herein. It should be noted that also in the present embodiment, as explained by using FIG. 14 in the first embodiment, masks may be selected without calculating the print duty.

Figure 20:
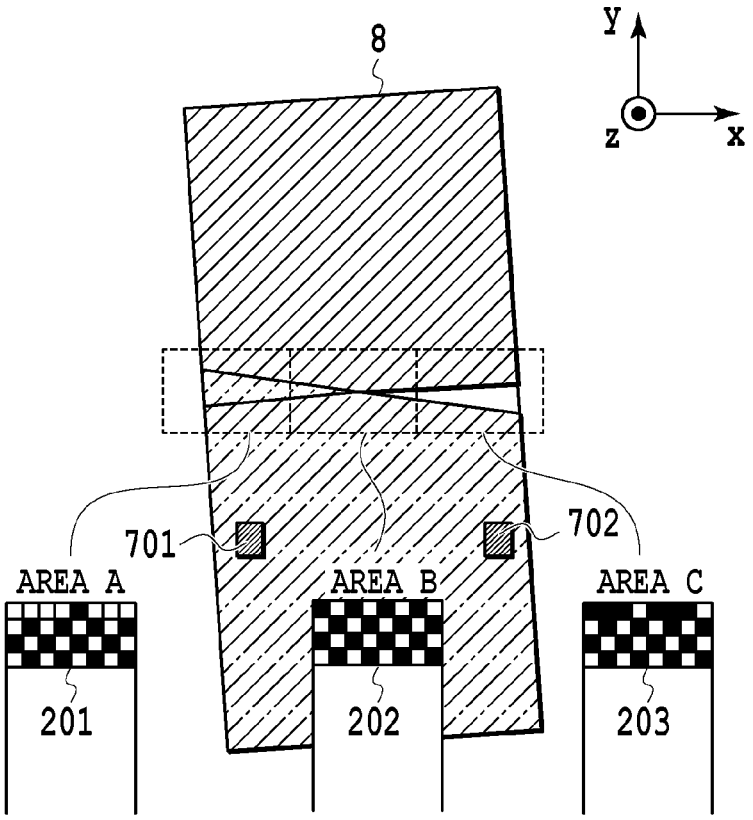
FIG. 20 is a diagram explaining correction of a connecting streak using masks.

FIG. 20 is a diagram explaining correction of a connecting streak using masks in the present embodiment. FIG. 20 shows a case where in step S2 in FIG. 19 a correction area is divided into three areas of area A, area B and area C.

As described above, in the present embodiment, the conveyance amount is adjusted such that the connecting streak is not generated in the center of the print medium. Therefore as shown in FIG. 20, the connecting streak is not generated in the center of the print medium 8. A white streak and a black streak are mixed in the central part (area B) including this center, but these streaks are generated to the extent that the density unevenness is relatively indistinctive. Accordingly mask 202 that does not increase or decrease the number of dots is used in area B.

As shown in FIG. 20, it is possible that a white streak and a black streak each are generated at both ends of the print medium 8 in the x direction by adjusting the conveyance amount. However, the extent of the connecting streak (width of an area where the connecting streak is generated) in each of both the ends is reduced, and therefore it is possible to reduce a correction amount (increasing number of dots/decreasing number of dots) for correcting this connecting streak.

As shown in FIG. 20, in area A positioned in the measuring device 701-side, the conveyance amount of the print medium 8 is shorter than a desired a conveyance amount to possibly generate a black streak, and therefore mask 201 for reducing the number of end dots is used. In area C positioned in the measuring device 702-side, the conveyance amount of the print medium 8 is longer than the desired a conveyance amount to possibly generate a white streak, and therefore mask 203 for increasing the number of end dots is used.

As described above, in the present embodiment, the conveyance amount of the print medium is adjusted for the connecting streak not to be generated in the center of the print medium, and thereby the extent of the connecting streak in the central part including the center is made to the extent that the correction is not necessary. In addition, the conveyance amount of the print medium is adjusted for the connecting streak not to be generated in the center of the print medium, and thereby the extent of the connecting streak at both ends across the central part in the main scan direction is reduced. Thereby it is possible to eliminate the correction amount for correcting the connecting streak at both the ends.

Other Embodiments

In the above embodiment, the method of finding the conveyance error amount for each conveyance of the print medium is explained. However, in a case where the conveyance error amount specific to the printing apparatus is in advance found, this may be used as a fixed value.

In the above embodiment, the method of switching the mask used in the final scan (second print scan in a case of a two-pass print, and fourth print scan in a case of a four-pass print) for completing an image in a predetermined area in a multi-pass print is explained. However, the switching processing of the mask in the main scan direction is not limited to the print scanning time.

For example, application of mask 132 explained with reference to FIG. 15 may be made at a first print scanning time. In this case, the mask used in the first print scan and the mask used in the second print scan will be exchanged. A conveyance error amount used for calculation of the oblique motion amount at this time may be one generated at conveyance for the first print scan or in a case where a conveyance error has been generated in the past print, may be the past conveyance error. In addition, an end ejection opening in this case means an ejection opening positioned in a y-direction end in one ejection opening group.

In addition, in the above embodiment, the method of adjusting the print duty in at least one raster area in the downstream side in the y direction is explained. However, an area used for adjustment of the print duty is not limited to this area, and at least one raster area in the upstream side in the y direction may be used. By doing so, the density unevenness can be suppressed in a case where generation of the connecting streak is predicted between the image and an image to be printed next.

It should be noted that in the above embodiment, the printing apparatus is explained using the inkjet printing apparatus as an example, but the above-mentioned method may be applied to a printing apparatus having a method such as a thermal transfer method or wire dot method.

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment (s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-172461, filed Aug. 22, 2013, which is hereby incorporated by reference herein in its entirety.

What is claimed is:

1. A printing apparatus comprising:

a print head for applying ink on a print medium;

a print control unit configured to control the print head to perform printing onto the print medium while moving the print head in a predetermined direction relative to the print medium;

a conveying unit configured to convey the print medium in a conveying direction crossing the predetermined direction;

an obtaining unit configured to obtain information regarding a plurality of conveyance errors of conveyance of the print medium in the conveying direction by the conveying unit, the information regarding the plurality of conveyance errors being obtained with respect to a plurality of areas of the print medium, respectively, that are in positions different from each other in the predetermined direction; and an adjusting unit configured to adjust an amount of ink to be applied onto each of a plurality of correction areas aligned in the predetermined direction in accordance with the plurality of conveyance errors for each of the plurality of areas indicated by the information obtained by the obtaining unit, the plurality of correction areas corresponding to the plurality of areas, respectively.

2. The printing apparatus according to claim 1, further comprising:

a determining unit configured to determine a print duty in accordance with print data to be printed for each of the plurality of correction areas, wherein the adjusting unit adjusts the amount of ink to be applied to each of the plurality of correction areas, corresponding to the print duty in accordance with the print data and the conveyance error amount for each of the plurality of correction areas.

3. The printing apparatus according to claim 1, wherein the conveying unit winds back the print medium in a case where a conveyance amount obtained by the obtaining unit is longer than a predetermined conveyance amount, and further conveys the print medium in a case where the obtained conveyance amount is shorter than the predetermined conveyance amount, and the adjusting unit adjusts an application amount of ink at both ends of the print medium across the central part including the center thereof in the predetermined direction.

4. The printing apparatus according to claim 1, further comprising:

at least two measuring devices arranged in different positions in the predetermined direction.

5. The printing apparatus according to claim 1, wherein the obtaining unit obtains a conveyance amount of the print medium, finds a conveyance error amount from the conveyance amount, and calculates an oblique motion amount of the print medium from the conveyance error amount, and the adjusting unit determines the number of the correction areas based upon the oblique motion amount calculated by the obtaining unit.

6. The printing apparatus according to claim 5, wherein the conveyance error amount for each of the plurality of correction areas is found from the oblique motion amount calculated by the obtaining unit.

7. The printing apparatus according to claim 5, wherein in a case where the oblique motion amount calculated by the obtaining unit exceeds a predetermined value, the printing is stopped.

8. The printing apparatus according to claim 1, wherein the print control unit controls the print head to print an image on the print medium by a plurality of movements onto a unit area of the print medium, wherein the apparatus further comprises:

a storage unit configured to store a plurality of masks in which a pixel allowing a print into the unit area and a pixel not allowing the print thereinto are defined, in each of the plurality of movements; and a selecting unit configured to select a mask corresponding to each of the plurality of correction areas from the plurality of masks in accordance with the conveyance error amount for each of the plurality of correction areas, and wherein the adjusting unit adjusts the amount of ink to be applied to each of the plurality of correction areas by using the mask selected by the selecting unit for each of the plurality of correction areas.

9. The printing apparatus according to claim 8, wherein the plurality of masks include a mask for adjusting a print duty in at least one raster in an end in a unit area of the print medium in the conveying direction.

10. The printing apparatus according to claim 8, wherein the storage unit stores a table where conveyance error amounts, print duties to be printed for each of the plurality of correction areas, and the masks are associated with each other.

11. The printing apparatus according to claim 8, wherein the adjusting unit adjusts the amount of ink to be applied onto each of the plurality of correction areas in one predetermined movement in the plurality of movements of the print head, and the one predetermined movement is a final movement at the time of completing an image on the unit area by the plurality of movements of the print head.

12. The printing apparatus according to claim 11, wherein the obtaining unit obtains a conveyance amount of the print medium for each of a plurality of conveyance operations for a print operation by the plurality of movements of the print head, finds a conveyance error amount for each of the plurality of conveyance operations by the obtained conveyance amount for each of the plurality of conveyance operations, and calculates an oblique motion amount of the print medium from a sum of the conveyance error amounts.

13. The printing apparatus according to claim 8, wherein the storage unit stores a table where conveyance error amounts and the masks are associated with each other.

14. The printing apparatus according to claim 13, wherein the table is prepared for each color of ink.

15. The printing apparatus according to claim 13, wherein the table is prepared for each kind of the print medium.

16. A printing method in a printing apparatus including a print head for applying ink on a print medium, and a conveying unit configured to convey the print medium in a conveying direction crossing a predetermined direction, the printing method comprising the steps of:

obtaining information regarding a plurality of conveyance errors of conveyance of the print medium in the conveying direction by the conveying unit, the information regarding the plurality of conveyance errors being obtained with respect to a plurality of areas of the print medium, respectively, that are in positions different from each other in the predetermined direction;

adjusting an amount of ink to be applied onto each of a plurality of correction areas aligned in the predetermined direction in accordance with the plurality of conveyance errors for each of the plurality of areas indicated by the information obtained by the step of obtaining, the plurality of the correction areas corresponding to the plurality of the areas, respectively; and controlling the print head to perform printing onto the print medium based upon the amount of ink adjusted in the step of adjusting while moving the print head in the predetermined direction relative to the print medium.

17. The printing method according to claim 16, wherein in the step of controlling, the print head is controlled to print an image on the print medium by a plurality of movements onto a unit area of the print medium, wherein the method further comprises the step of:

selecting a mask corresponding to each of the plurality of correction areas from a plurality of masks in which a pixel allowing printing into the unit area and a pixel not allowing the print thereinto are defined, in each of the plurality of movements, and wherein in the step of adjusting, the amount of ink to be applied to each of the plurality of correction areas is adjusted by using the mask selected by the step of selecting for each of the plurality of correction areas.

18. The printing method according to claim 16, further comprising the step of:

determining a print duty in accordance with print data to be printed for each of the plurality of correction areas, wherein in the steps of adjusting, the amount of ink to be applied to each of the plurality of correction areas is adjusted corresponding to the print duty in accordance with the print data and the conveyance error amount for each of the plurality of correction areas.

19. The printing method according to claim 16, wherein in the step of obtaining, a conveyance amount of the print medium is obtained, a conveyance error amount is found from the conveyance amount, and an oblique motion amount of the print medium is calculated from the conveyance error amount, and in the step of adjusting, the number of the correction areas is determined based upon the oblique motion amount calculated by the step of obtaining.

20. The printing method according to claim 19, wherein the conveyance error amount for each of the plurality of correction areas is found from the oblique motion amount calculated in the step of obtaining.

* * * * *